US006305977B1

(12) United States Patent
Ozaki

(10) Patent No.: US 6,305,977 B1
(45) Date of Patent: Oct. 23, 2001

(54) END STRUCTURE FOR COAXIAL CONNECTOR AND METHOD OF TREATING END THEREOF

(75) Inventor: Masahito Ozaki, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/484,255

(22) Filed: Jan. 18, 2000

(30) Foreign Application Priority Data

Feb. 5, 1999 (JP) ..... 11-029178

(51) Int. Cl.[7] ..... H01R 9/05
(52) U.S. Cl. ..... 439/578
(58) Field of Search ..... 439/578, 585, 439/583, 584, 581, 582

(56) References Cited

U.S. PATENT DOCUMENTS

| | | | | |
|---|---|---|---|---|
| 4,010,538 | * | 3/1977 | O'Keefe et al. | 439/578 X |
| 4,269,469 | * | 5/1981 | Audie | 439/578 |
| 4,990,104 | * | 2/1991 | Schieferly | 439/578 |
| 5,037,328 | * | 8/1991 | Karlovich | 439/578 |
| 5,052,944 | * | 10/1991 | Mitani et al. | 439/394 |
| 5,186,656 | * | 2/1993 | Harwath et al. | 439/585 |
| 5,246,384 | * | 9/1993 | Sato | 439/585 |
| 5,803,767 | * | 9/1998 | Matsumoto | 439/578 |
| 6,033,260 | * | 3/2000 | Murata et al. | 439/578 |
| 6,065,998 | * | 5/2000 | Peloza | 439/578 |

FOREIGN PATENT DOCUMENTS

| | | |
|---|---|---|
| 55-129383 | 9/1980 | (JP) . |
| 2-273481 | 11/1990 | (JP) . |
| 4-52371 | 5/1992 | (JP) . |
| 7-22107 | 1/1995 | (JP) . |

* cited by examiner

*Primary Examiner*—Tulsidas Patel
(74) *Attorney, Agent, or Firm*—Oblon, Spivak, McClelland, Maier & Neustadt, P.C.

(57) ABSTRACT

An end structure is provided for a coaxial connector where an exposed braided wire of a shield wire is press-fitted to a shield terminal. In the structure, the shield terminal includes a bottom par, a pair of half-box parts on both sides of the bottom part and a pair of press-fitting pieces for the braided wire. The parts are capable of plastic deformation to their closing position where their opposing end faces come into contact with each other. By closing the box part, an inner housing, an inner terminal and a part of exposed braided wire are covered with the shield terminal, while the braided wire is press-fitted to the pair of press-fitting pieces.

4 Claims, 10 Drawing Sheets

END STRUCTURE FOR COAXIAL CONNECTOR AND METHOD OF TREATING END THEREOF

BACKGROUND OF THE INVENTION

1. Field of the Invention

The present invention relates to an end structure for a high-frequency coaxial connector required to be electromagnetically insulated from the outside and also relates to a method of treating the end of the high-frequency coaxial connector.

2. Description of the Related Art

Japanese Utility Model Publication (kokai) No. 4-52371 discloses a high-frequency coaxial connector. FIG. 1 is a perspective view of the above coaxial connector and FIG. 2 is a sectional view of the connector.

As shown in FIGS. 1 and 2, a shield wire 1 is provided with a core line 1*a*, an insulating inner rind 1*b*, and a braided wire 1*c* all of which are exposed from an insulating outer rind 1*d* at the end of the wire 1. A rod-shaped terminal 2 is press-fitted to the exposed core 1*a*. A shield member 3 includes a terminal retainer 3*a* in the form of a rectangular box, and a pair of shield pieces 3*b*, 3*c* connected with the terminal retainer 3*a* through a hinge 4. A terminal insertion hole 5 is formed in the terminal retainer 3*a*. The terminal 2 is adapted so as to be connected with the shield wire 1 and inserted into the terminal inserting hole 5.

The pair of shield pieces 3*b*, 3*c* are formed so as to be displaceable from an opening position for opening their abutting faces to the closing position for abutting the abutting faces against each other. Each of the shield pieces 3*b*, 3*c* is provided, on an end face thereof, with a contact face 6 for contact with the braided wire 1*c* of the shield wire 1.

With the above-mentioned constitution, the terminal 2 connected to the shield wire 1 is inserted into the shield member 3 through an opening between the shield pieces 3*b*, 3*c* and further inserted into the terminal insertion hole 5. Next, the pair of shield pieces 3*b*, 3*c* are closed, so that the abutting faces abut on each outer while the respective contact faces 6 come in contact with the braided wire 1*c*. Consequently, the terminal 2 is electrically connected with the shield member 3, while the terminal 2 and the exposed tore 1*a* are magnetically insulated from the outside by the shield member 3.

Japanese Patent Publication (kokai) No. 7-22107 discloses a high-frequency coaxial connector. FIG. 3 is a sectional view of the above coaxial connector before assembling an insulating member and FIG. 4 is a sectional view of the connector after assembling the member.

As shown in FIGS. 3 and 4, a shield wire 1' is provided with the core line 1*a*, the insulating inner rind 1*b*, and the braided wire 1*c* all of which are exposed from the insulating outer rind 1*d* at the end of the wire 1. An inner terminal 2' is electrically connected to the exposed core 1*a*. A shield terminal 7 includes a retainer 7*a* in the form of a rectangular cylinder, a "braided wire" press-fitting part 7*b* extended from the rear end of the retainer 7*a* and a "insulating rind" press-fitting part 7*c* succeeding to the part 7*b*. In the rectangular cylindrical retainer 7*a*, an inner housing 8 is arranged to accommodate the terminal and provided with a groove part 8*a*. Respective openings 7*d*, 8*d* are formed on the retainer 7*a* and the top face of the inner housing 8, respectively. The openings 7*d*, 8*d* are adapted so as to be covered with a covering member 9.

With the above-mentioned constitution, the inner terminal 2' connected to the shield wire 1' is inserted into the groove part a of the inner housing 8 through the respective opening 7*d* of the terminal 7 and the opening 8*d* of the inner housing 8. Next, the covering member 9 is attached to the inner housing 8 to close the opening 8*d*. Further, by crimping the press-fitting parts 7*b*, 7*c*, the press-fitting part 3*b* is pressure-connected to the braided wire 1*c* while the press-fitting part 7*c* is pressure-connected to the insulating outer rind 1*d*. In this manner, the inner terminal 2' is electrically connected with the shield terminal 7, while the terminal 2' and the exposed core 1*c* are magnetically insulated from the outside by the shield terminal 7, similar to the previously-mentioned prior art.

In the former prior art, however, there is a problem of incomplete assembly with the result being that the pair of shield pieces 3*b*, 3*c* are easily deformed by an external force in a direction to separate the pieces 3*b*, 3*c* from each other because the contact between the respective faces 6 and the braided wire 1*c* of the shield wire 1 is attained owing to the plastic deformation of the shield pieces 3*b*, 3*c* of the shield member 3. In detail, if the shield pieces 3*b*, 3*e* are subjected to an external force to open them, then there is easily produced a clearance between the opposing faces of the shield pieces 3*b*, 3*c*, so that a electrical contact between the faces 6 and the braided wire 14 becomes incomplete, thereby deteriorating the shielding capability.

In the latter prior art, conversely, the assembling condition is stable owing to the arrangement where the shield terminal 7 is connected to the shield wire 1' through the press-fitting part 3*b* for the braided wire 1*c* and the press-fitting part 7*c* for the insulating out rind 1*d*. However, since the rear opening d. of the shield terminal 7 and the rear opening d. of the inner housing 8 are respectively closed by the covering member 9, the number of components is so large that the number of assembly steps is increased, causing an increase in manufacturing costs. Additionally noted, unless the opening d., d. are closed by the covering opening 9, the shielding capability would be deteriorated in a high-frequency band range, particularly.

SUMMARY OF THE INVENTION

Under such a circumstance, it is therefore an object of the present invention to provide an end structure for a coaxial connector which is complete in its assembling condition and capable of maintaining the shielding capability without increasing the number of components and assembling steps.

Further, it is another object to provide a method of treating the end of the coaxial connector.

The objects of the present invention described above can be accomplished by an end structure for a coaxial connector comprising:

- a shield wire having a conductive core, an insulating inner rind covering the core, a conductive braided wire covering the insulating inner rind and an insulating outer rind covering the braided wire, the shield wire being partially peeled at an end thereof so as to expose the core, the insulating inner rind and the braided wire;
- an inner terminal to be press-fitted to the exposed core for electrical connection;
- an inner housing made of insulating material, the inner housing having an inner terminal accommodating part formed for accommodating the inner terminal inserted thereinto;
- a shield terminal to be assembled to the inner terminal and the exposed braided wire through the inner housing so as to attain an electrical connection with the braided wire, the shield terminal being configured to be connectable with the exposed braided wire by the shield terminal's press-fitting so as to cover at least the inner terminal and the exposed insulating inner rind;

wherein the shield terminal includes:

a bottom part;

a pair of half-box parts formed to stand on both sides of the bottom part integrally and allow of plastic deformation due to press-fitting to their closing position where respective opposing end faces of the half-box parts butt each other; and a pair of press-fitting parts formed to stand on both sides of the bottom part and also configured to be connectable with the exposed braided wire by the press-fitting parts' press-fitting;

whereby the inner housing, the inner terminal and the exposed braided wire's part on the insulating inner rind's side are covered with the pair of half-box parts being deformed to their closing position, while the exposed braided wire is connected to the pair of press-fitting parts since they are press-fitted to the exposed braided wire.

With the above-mentioned structure, it is possible to complete the assembling of the shield terminal to the shield wire and improve the shielding capability of the coaxial connector without increasing the number of components and assembling steps. Additionally, with no increase in number of components and assembling steps, the manufacturing cost can be saved.

According to the second aspect of the invention, in the above-mentioned invention, the whole periphery of the inner housing is brought into contact with the opposing end faces on the side of respective front ends of the half-box parts being deformed to their closing position, while the whole periphery of the braided wire is brought into contact with the opposing end faces on the side of respective rear ends of the half-box parts being deformed to their closing position.

In this case, since the inner terminal and the exposed braided wire of the shield wire are covered with the pair of half-box parts of the shield terminal in general perfect, the shielding capability is further improved.

According to the third aspect of the invention, in the above-mentioned invention, the inner housing is provided, in the inner terminal accommodating part, with a flexible hook for engagement with the inner terminal.

In this case, owing to the provision of the flexible hook, the connection

According to the fourth aspect of the invention, in addition to the above constituents of the end structure, it may comprise an outer housing made of insulating material and having a terminal accommodating part formed for accommodating the shield terminal being assembled to the shield wire, wherein the shield terminal has a lower engagement claw formed on the bottom part for engagement with the outer housing and upper engagement claws formed on the half-box parts for engagement with the outer housing.

In this case, owing to the addition of the outer housing, the shielding capability of the coaxial connector is further improved. Furthermore, owing to the provision of the respective claws, the connection between the outer housing and the shield terminal is further strengthened.

According to the fifth aspect of the invention, the end structure may further comprise a spacer for locking the shield terminal accommodated in the outer housing, wherein the outer housing has a spacer insertion hole allowing the spacer to be inserted thereinto.

In this case, owing to the insertion of the spacer into the outer housing, the shield terminal is accommodated in the outer housing stably.

According to the sixth aspect of the present invention, there is also provided a method of treating an end of a coaxial connector, comprising the steps of:

preparing a shield wire consisting of a conductive core, an insulating inner rind covering the core, a conductive braided wire covering the insulating inner rind and an insulating outer rind covering the braided wire:

peeling the shield wire partially so as to expose the core, the insulating inner rind and the braided wire;

preparing an inner terminal and sequentially press-fitting the inner terminal to the exposed core for electrical connection;

preparing an inner housing made of insulating material, the inner housing having an inner terminal accommodating part formed for accommodating the inner terminal inserted thereinto;

preparing a shield terminal made of conductive metal, the shield terminal including:

a bottom part;

a pair of half-box parts formed to stand on both sides of the bottom part integrally and allow of plastic deformation due to press-fitting to their closing position where respective opposing end faces of the half-box parts butt each other; and a pair of press-fitting parts formed to stand on both sides of the bottom part and also configured to be connectable with the exposed braided wire by the press-fitting parts' press-fitting;

inserting the inner terminal into the inner housing through a rear opening thereof, thereby completing an inner housing assembly;

installing the inner housing assembly into the shield terminal through a clearance between the pair of half-box parts in their opening position;

press-fitting the insulating outer rind and the exposed braided wire of the shield wire to the press-fitting parts of the shield terminal by using a press-fitting machine; and simultaneously press-fitting the pair of half-box parts in the opening position thereby to close them by using the press-fitting machine.

According to the above method, since the shield terminal closing process is carried out simultaneously with the crimping process to fit the braided wire under pressure and the crimping process to fit the insulating outer rind under pressure, the number of components and assembling steps is reduced, so that the assembling process can be executed effectively.

According to the seventh aspect of the present invention, in the above method, it further comprises the steps of:

preparing an outer housing made of insulating material and having a terminal accommodating part formed for accommodating the shield terminal being assembled to the shield wire; and accommodating the shield terminal in the terminal accommodating part of the outer housing.

In this case, owing to the addition of the above steps, the shielding capability of the coaxial connector is further improved.

According to the eighth aspect of the invention, the above method further comprises the steps of:

preparing a spacer for locking the shield terminal accommodated in the outer housing; and inserting the spacer into the outer housing, thereby locking the shield terminal in the outer housing.

In this case, owing to the addition of the above steps, the shield terminal is accommodated in the outer housing stably.

According to the ninth aspect of the invention, in the above method, the shield terminal has a lower engagement claw formed on the bottom part for engagement with the outer housing and upper engagement claws formed on the half-box parts for engagement with the outer housing.

In this case, owing to the provision of the respective claws, the connection between the outer housing and the shield terminal is further strengthened.

These and other objects and features of the present invention will become more fully apparent from the following description and appended claims taken in conjunction with the accompany drawings.

DESCRIPTION OF THE PREFERRED EMBODIMENT

One embodiment of the present invention will be described with reference to the drawings.

FIGS. 5 to 15 show an end structure of a high-frequency coaxial connector of the embodiment, also showing sequent steps of assembling the coaxial connector in accordance with a terminal treatment method of the invention. First described is the end structure of the coaxial connector and constituent members used in the end treating method and subsequently described are assembling the coaxial connector.

Figure 14:
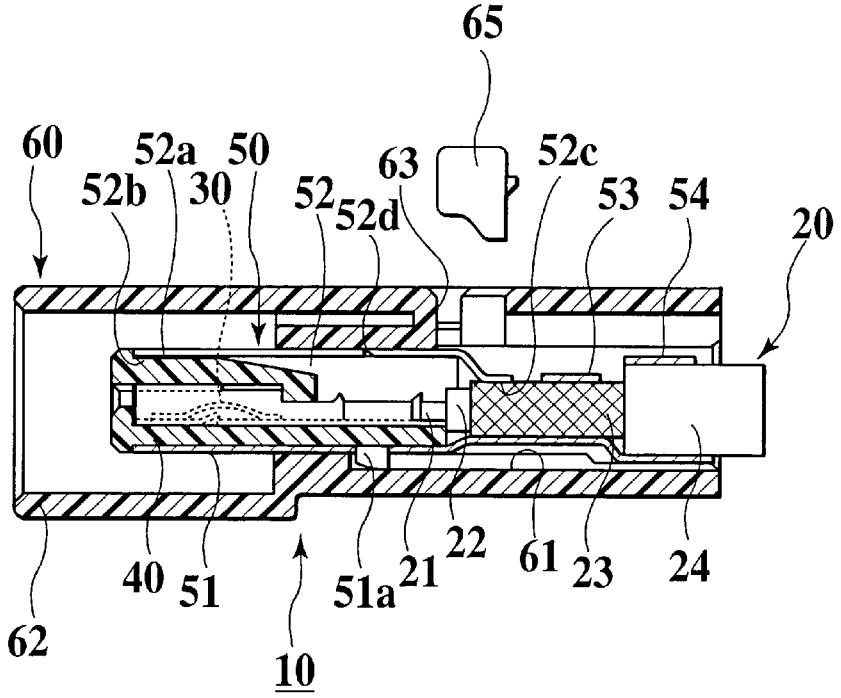
FIG. 14 is a sectional view of the end structure, showing a condition before inserting a spacer into the outer housing.
Figure 15:
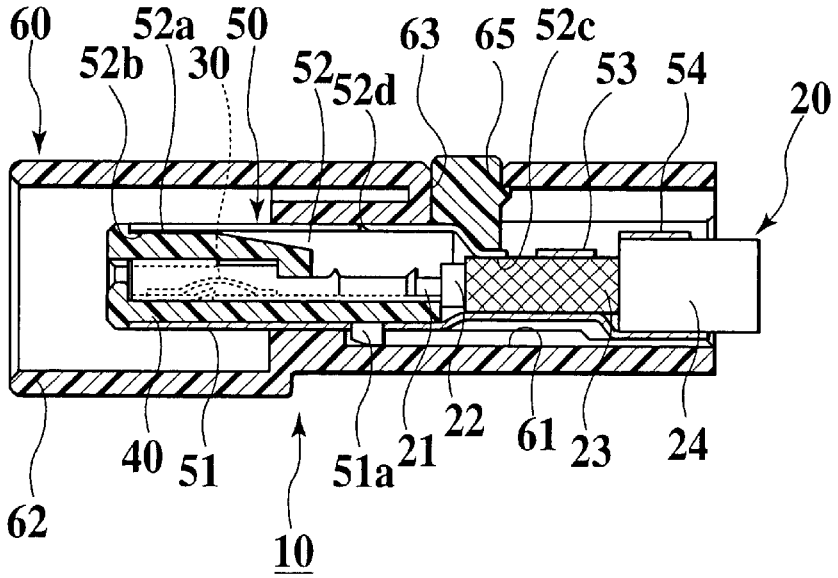
FIG. 15 is a sectional view of the end structure, showing a condition after inserting the spacer into the outer housing.

As shown in FIGS. 14 and 15, the high-frequency coaxial connector 10 comprises a shield wire (i.e. coaxial cable) 20, a female inner terminal 30, a synthetic inner housing 40, a shield terminal 50 and a synthetic outer housing 60.

As shown in FIGS. 5 to 15, the shield wire 20 is constituted by a core (bundle of lines) 21 of a conductor, an insulating inner rind 22 covering the core 21, a braided wire 23 as a shielding element around the insulating inner rind 22, and an insulating outer rind 24 arranged around the braided wire 23 for covering the core 21, the insulating inner rind 22 and the braided wire 23. At one end of the shield wire 20, it is peeled so as to expose the core 21, the insulating inner rind 22 and the braided wire 23 respectively.

Figure 6:
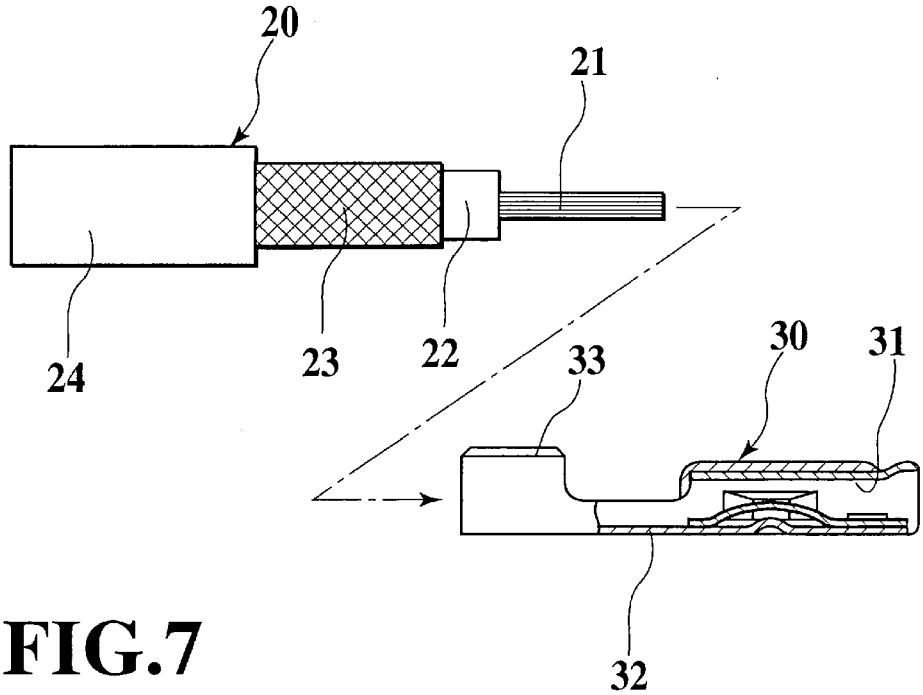
FIG. 6 is a sectional view of the end structure, showing a condition before assembling a shield wire for the end structure of the coaxial connector to an inner terminal.
Figure 7:
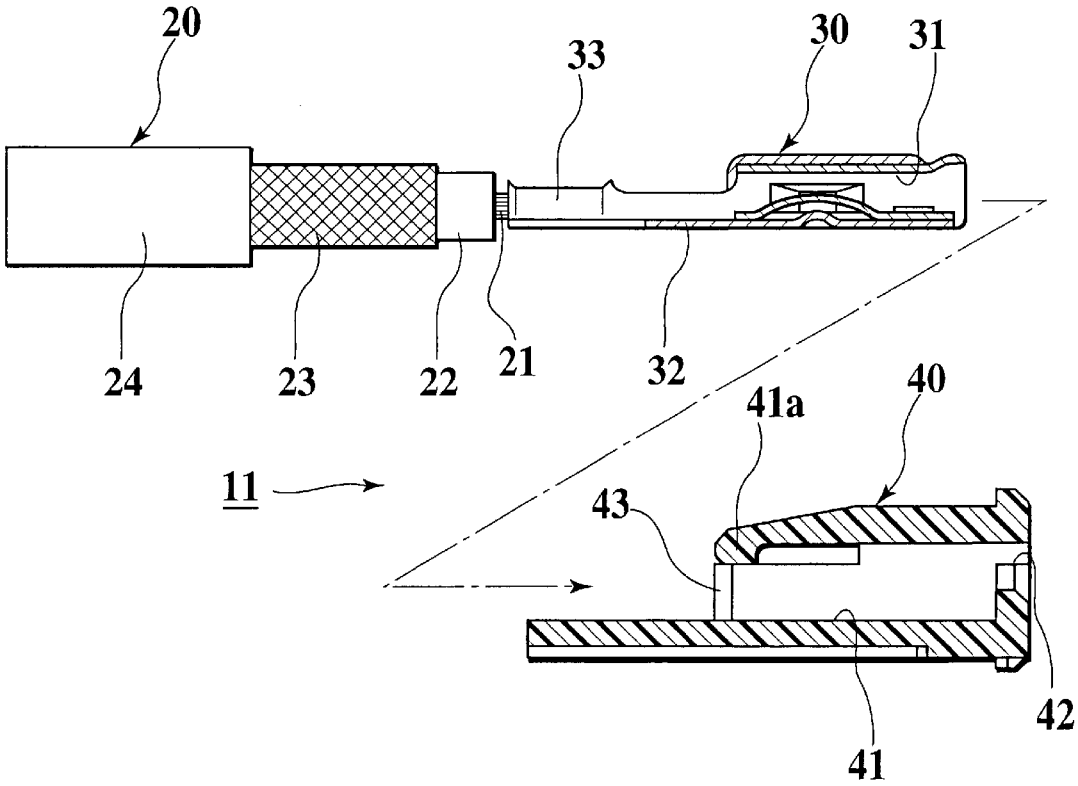
FIG. 7 is a sectional view of the end structure, showing a condition before further assembling the inner terminal connected to the shield wire into an inner housing.

As shown in FIGS. 6 and 7, the inner terminal 30 includes a terminal accommodating part 31 in the form of a rectangular cylinder, which is formed at the tip of the terminal 30 for allowing the mating terminal to be inserted for electrical contact, a bottom plate 32 formed integrally with the bottom part of the part 31 and a pair of press-fitting parts 33, 33 for the core 21, which are formed to stand on both rear sides of the bottom plate 32 upward. The pair of press-fitting parts 33, 33 are adapted so as to be press-fitted to the core 21 of the shield wire 20 by the crimping operation of a not-shown press-fitting machine.

Figure 8:
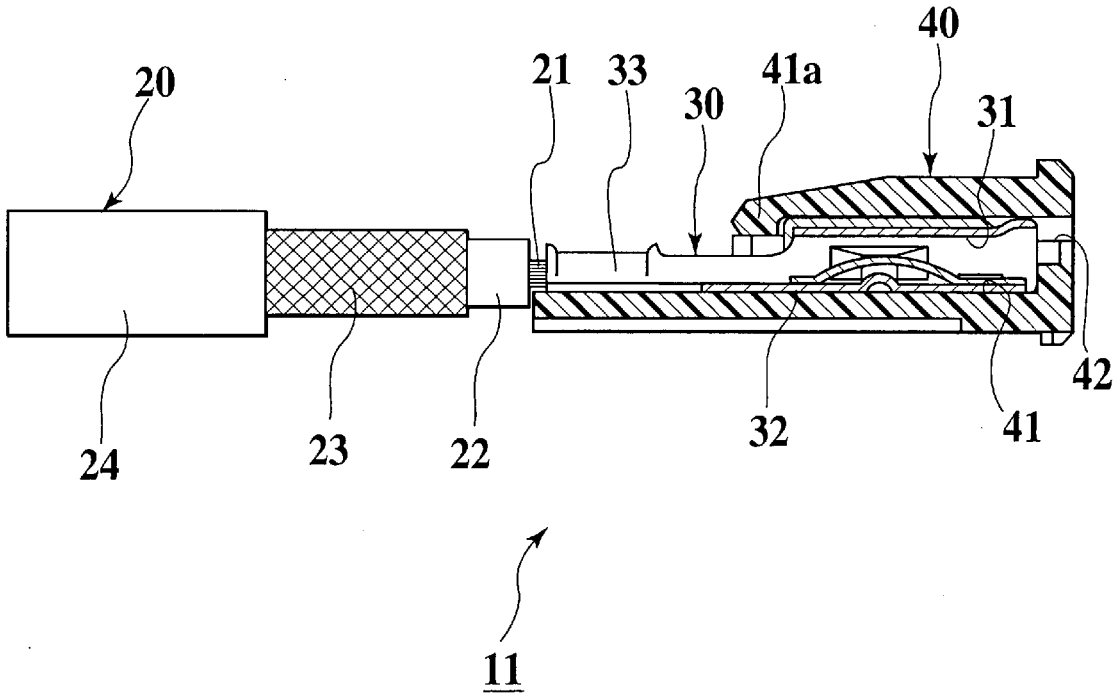
FIG. 8 is a sectional view of the inner housing assembly where the inner housing is assembled to the inner terminal.

As shown in FIGS. 7 and 8, the inner housing 40 is constituted by a molded insulating member and provided, inside thereof, with an inner terminal accommodating part 41. The inner terminal accommodating part 41 has a front wall provided with a terminal insertion hole 42 into which the mating terminal is to be inserted. The inner housing 40 is further provided with a rear opening 43 through which the inner terminal 30 is inserted into the inner terminal accommodating part 41. The inserted inner terminal 30 is locked in the inner housing 40 through a flexible upper hook 41*a* on the rear side of the inner terminal accommodating part 41. As shown in FIG. 8, the inner terminal 30 is inserted into the inner housing 40 through the rear opening 43, thereby completing an inner housing assembly 11.

As shown in FIGS. 5 and 9A to 15, the shield terminal 50 is provided by folding a conductive metal plate and comprises a bottom part 51, a pair of half-box parts 52, 52 standing on both sides of the bottom part 51 and capable of plastic deformation to a closed position where their opposing end faces 52*a*, 52*a* are brought into contact with each other by press-fitting. A pair, of press-fitting pieces (press-fitting parts) 53, 53 for the braided wire are formed to stand on both sides of the rear portion of the bottom part 51 are press-fitted to the exposed braided wire 23 of the shield wire 20 by press-fitting. A pair of press-fitting pieces (press-fitting parts) 54, 54 for the insulating outer rind are provided, which are formed to stand on both sides of the rear end of the bottom part '51 and are also press-fitted to the insulating outer rind 24 of the shield wire 20.

The shield terminal 50 is provided, on the bottom part 51, with a lower engagement claw 51*a*. The pair of half-box parts 52, 52 are capable of plastic deformation from their opening position to open a space between the opposing end faces 52*a*, 52*a* to the closing position where the end faces 52*a*, 52*a* comes into contact with each other The shield terminal 50 is constructed so that, in case of closing the half-box parts 52*a*, 52*a*, respective inner faces 52*b* (on the front side of insertion) of the half-box parts 52, 52 come into contact the whole periphery of the inner housing 40 while respective inner faces 52*c* (on the rear side of insertion) come into contact the whole periphery of the braided wire 23. Additionally, the shield terminal 50 has an upper engagement claw 52*d* formed on each top of the half-box parts 52, 52. The pair of half-box parts 52, 52 are adapted so as to be closed by a press-fitting machine 70 shown in FIGS. 10A, 10B and 11A, 11B. At the closing of the pair of half-box parts 52, 52, they cover the inner housing 40, the inner terminal 30 and the insulating inner rind 22 of the exposed braided wire 23, while the exposed braided wire 23 and the insulating outer rind 24 of the shield wire 20 are press-fitted to the pair of press-fitting pieces 53, 53 and the pair of press-fitting pieces 54, 54, respectively.

Figure 12:
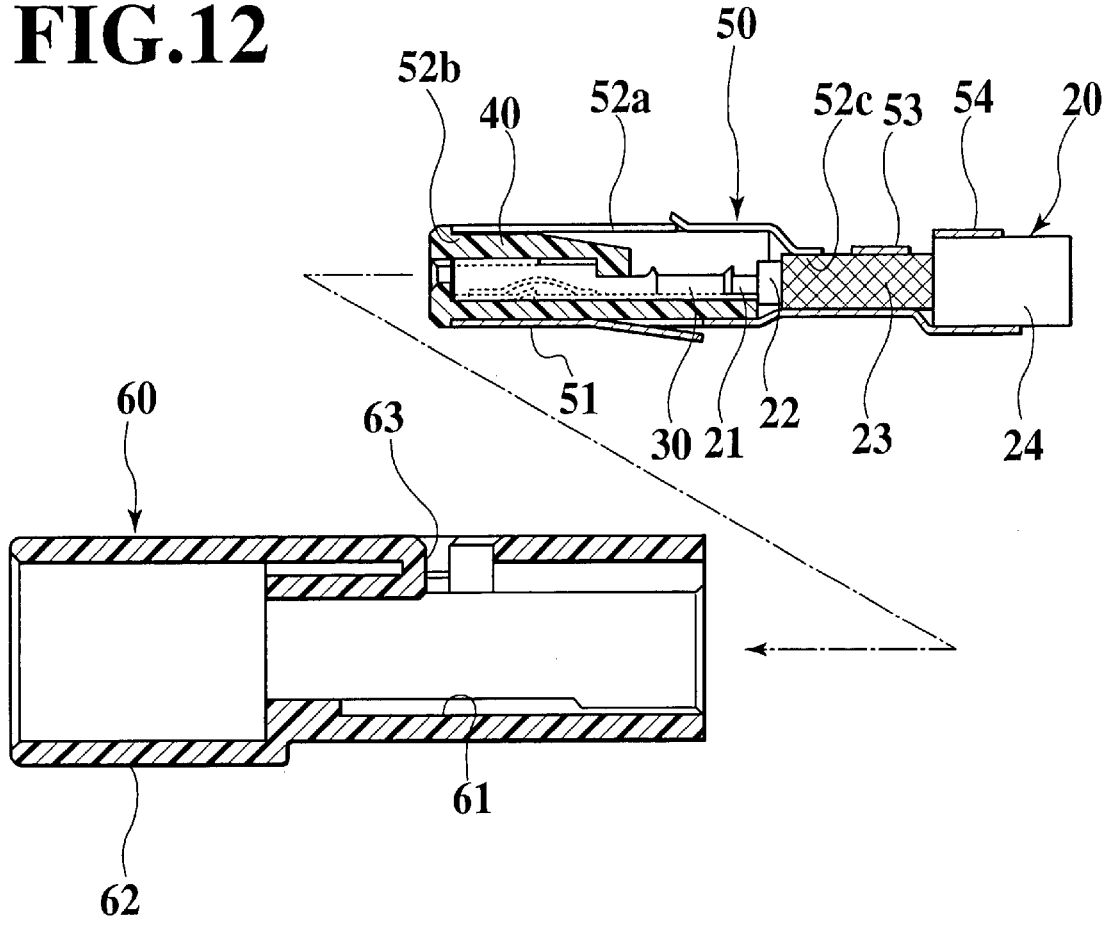
FIG. 12 is a sectional view of the end structure, showing a condition before fitting the shield terminal to an outer housing.

As shown in FIG. 12, the outer housing 60 is constituted by a insulating member molded in the form of a rectangular cylinder and also provided, inside thereof, with a terminal accommodating part 61 for accommodating the shield terminal 50. In front of the terminal accommodating part 61, a hood part 62 for fitting the mating terminal is formed to communicate with the part 61. Formed on the top wall of the outer housing 60 is a spacer-inserting hole 63 into which a synthetic spacer 65 is to be inserted and which opens to the terminal accommodating part 61.

As shown in FIGS. 10A, 10B and 11A, 11B, the press-fitting machine 70 includes an immovable mount 71 for mounting the shield terminal 50 assembled into the inner housing 11, a pair of side jigs 72, 72 disposed on both sides of the mount 71 to slide up and down, an upper front jig 73 capable of sliding up and down and an upper rear jig 74 also capable of sliding up and down.

Figure 1:
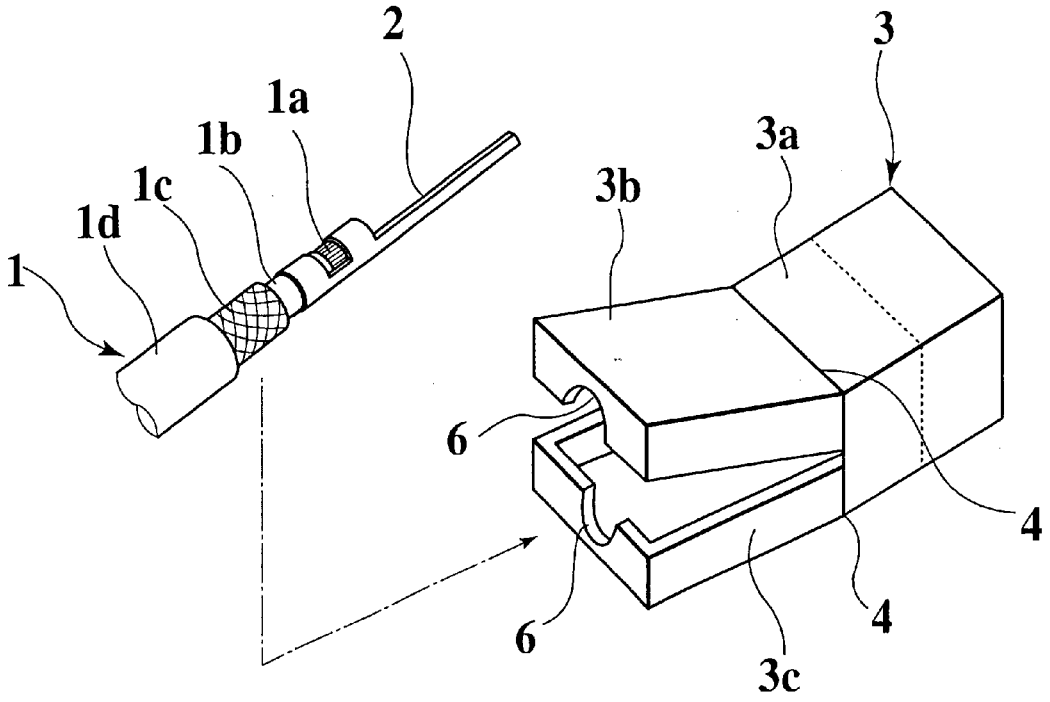
FIG.1 PRIOR ART
FIG. 1 is an exploded perspective view of a coaxial connector in the prior art.
Figure 2:
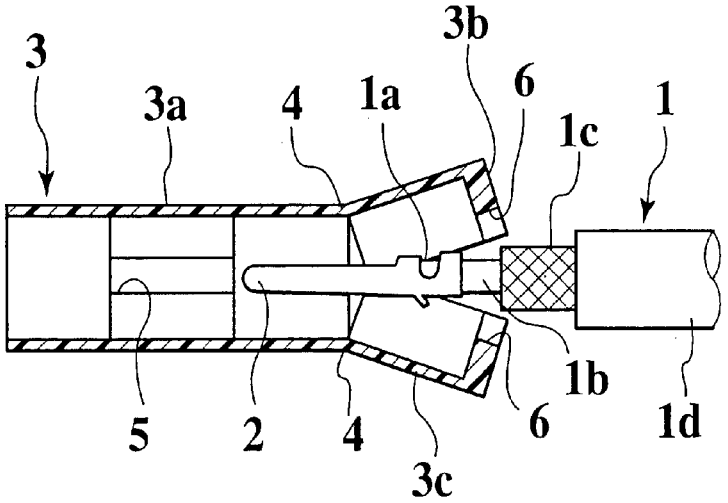
FIG.2 PRIOR ART
FIG. 2 is a sectional view of the coaxial connector of FIG. 1.
Figure 3:
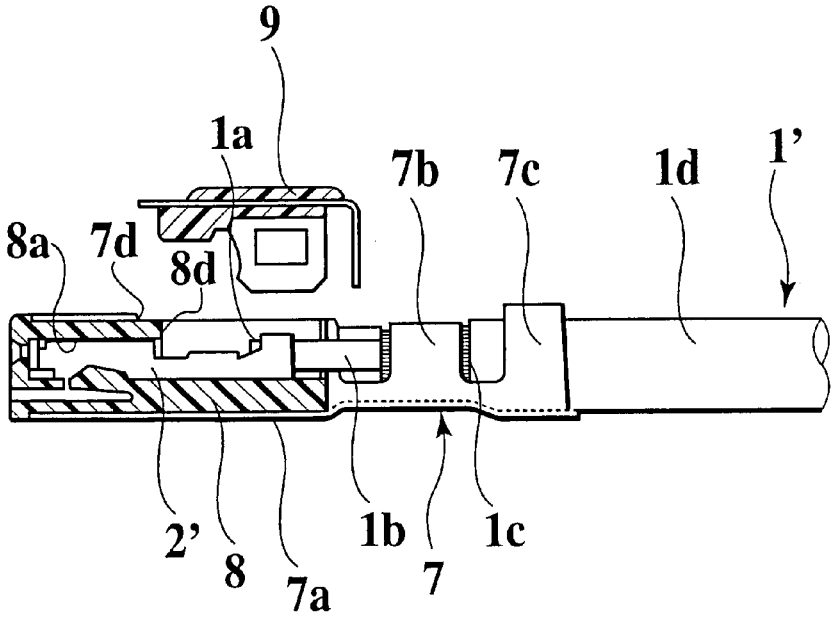
FIG.3 PRIOR ART
FIG. 3 is a sectional view of another coaxial connector in the prior art, showing a condition before fitting a covering member.
Figure 4:
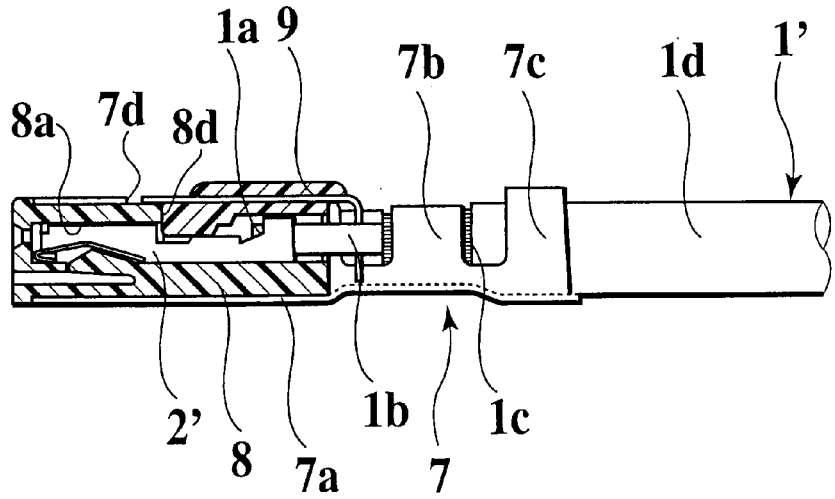
FIG.4 PRIOR ART
FIG. 4 is a sectional view of the coaxial connector of FIG. 3, showing a condition after fitting the covering member.
Figure 5:
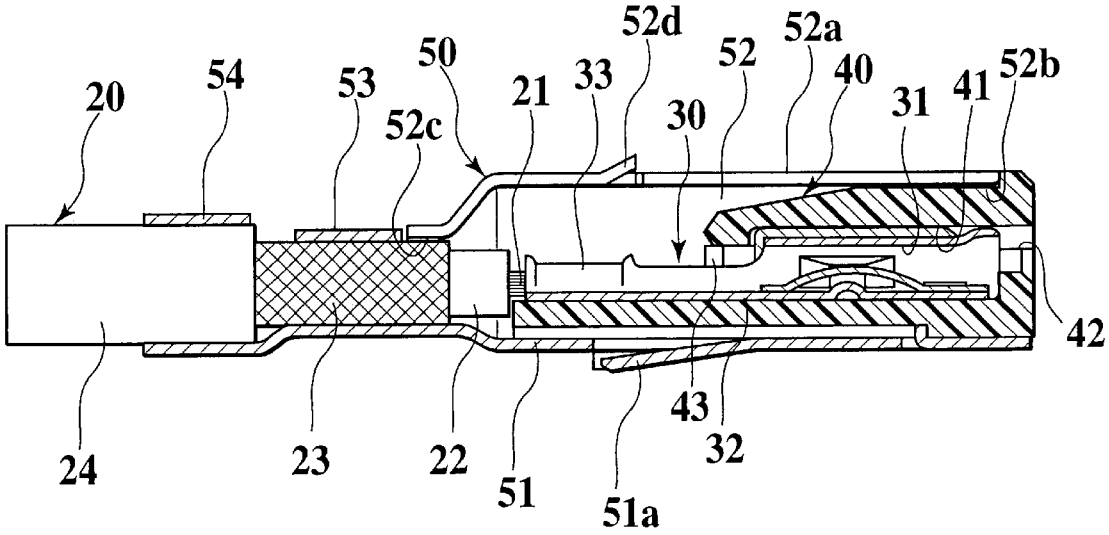
FIG. 5 is a sectional view of an end structure of a coaxial connector in accordance with an embodiment of the present invention, showing a condition that an inner housing assembly for the end structure is assembled into a shield terminal.

Next, the assembling steps of the coaxial connector 10 will be described with reference to FIGS. 5 to 15. First of all, in the treatment for the wire end, it is executed to peel the end of the shield wire 20 in order to expose the core 21, the insulating inner rind 22 and the braided wire 23, as shown in FIGS. 5 to 7.

Next, as shown in FIG. 6, the core 21 of the shield wire 20 is disposed between the pair of the press-fitting parts 33, 33 of the inner terminal 30 and subsequently crimped to connect the core 21 to the inner terminal 30 by press-fitting. Thereafter, as shown in FIG. 7, the inner terminal 30 is accommodated in the inner-terminal accommodating part 41 of the inner housing 40 through the rear opening 43, thereby completing the inner housing assembly 11 of FIG. 8. That is, in this inner-terminal treatment process to assemble the inner terminal 30 into the inner housing 40, the inner terminal 30 is electrically connected to the exposed core 21 of the shield wire 20.

Figure 9A:
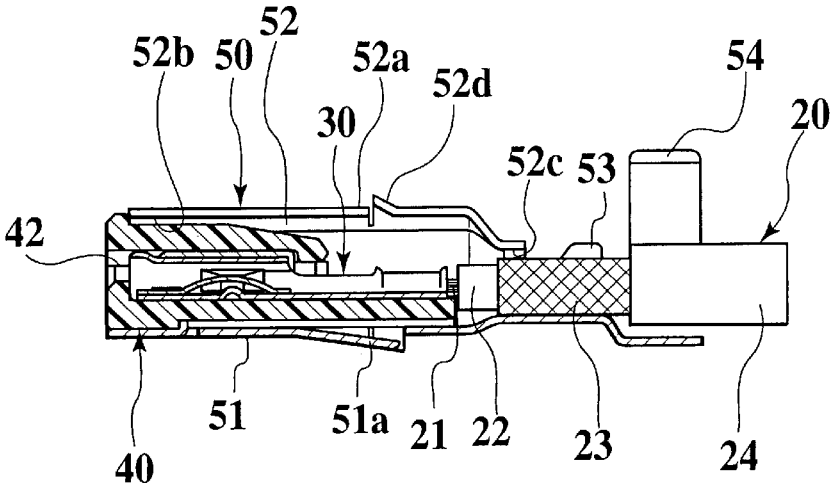
FIG. 9A is a sectional view of the end structure, showing a condition in process of fitting the inner housing assembly to the shield terminal.
Figure 9B:
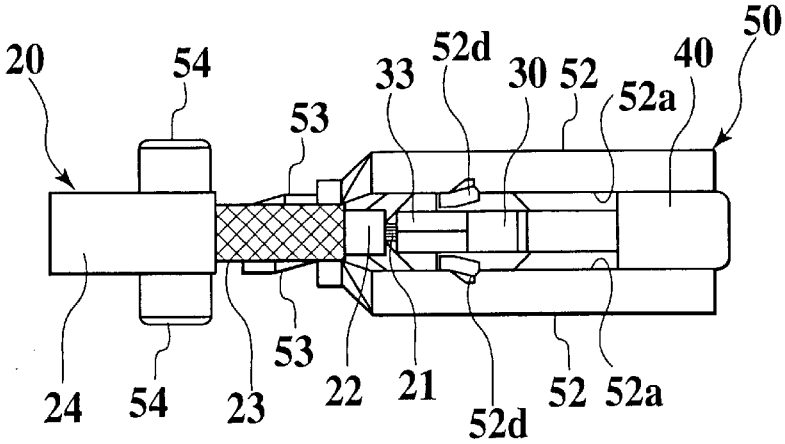
FIG. 9B is a plan view of FIG. 9A.
Figure 9C:
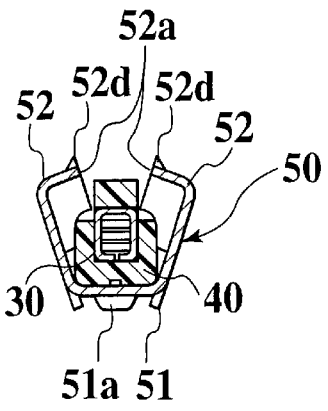
FIG. 9C is a longitudinal sectional view of FIG. 9A.
Figure 10A:
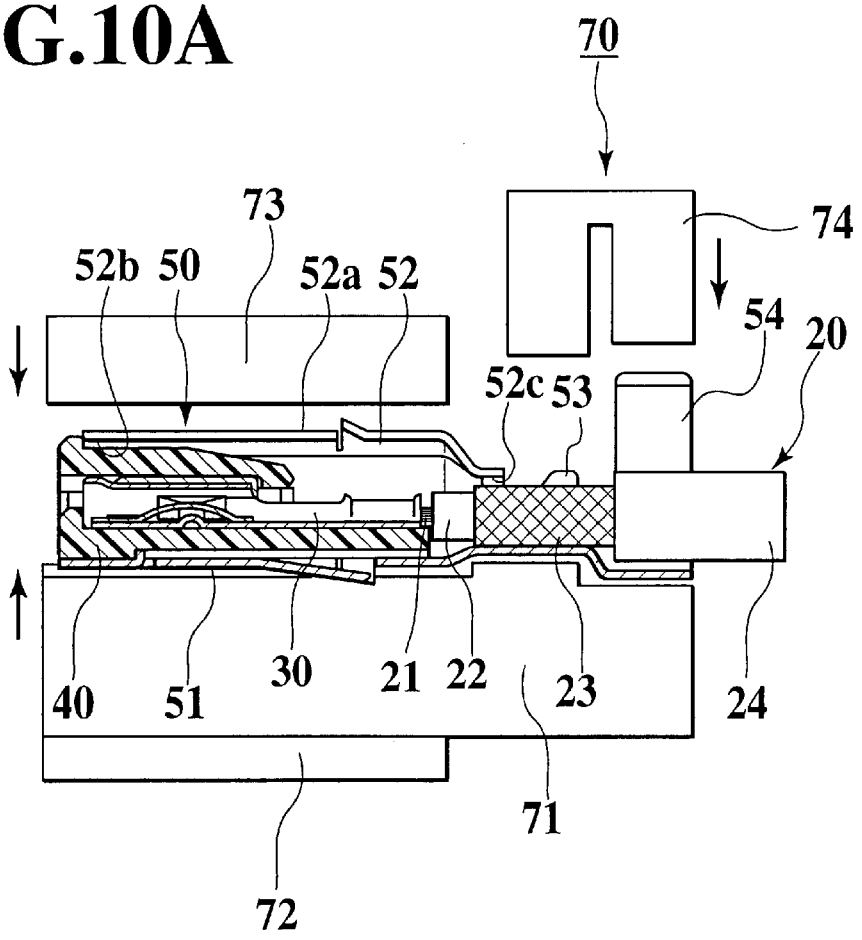
FIG. 10A is a sectional view of the end structure, showing a condition before applying press-fitting on the shield terminal by using a press fitting machine.
Figure 10B:
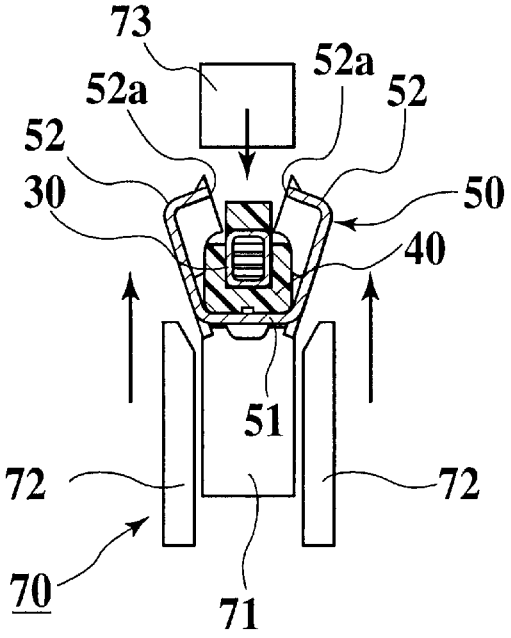
FIG. 10B is a longitudinal sectional view of FIG. 10A.

Next, as shown in FIGS. 9A to 9C, the above inner housing assembly 11 is inserted between the pair of half-box parts 52, 52 of the shield terminal 50 through the opening between the half-box parts 52, 52. Simultaneously, the shield wire 20 is positioned so as to dispose its end portion between the press-fitting pieces 52, 53 (for the braided wire) and also between the press-fitting pieces 54, 54 (for the insulating outer rind) upon the temporary installation. Thereafter, the built-in shield terminal 50 is laid on the mount 71 of the press-fitting machine 70. Then, as shown with arrows in FIGS. 10A and 10B, the pair of side jigs 72, 72 are slid from their lowermost positions to the uppermost positions while sliding the upper front jig 73 and the upper rear jig 74 from their upper most position toward the lowermost positions.

Figure 11A:
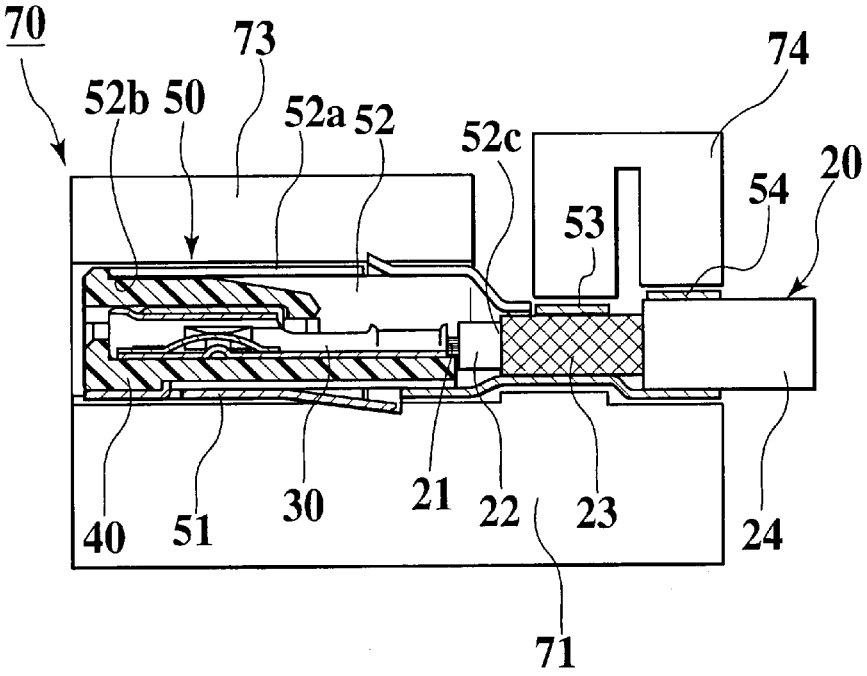
FIG. 11A is a sectional view showing a condition after press-fitting the shield terminal by the press fitting machine.
Figure 11B:
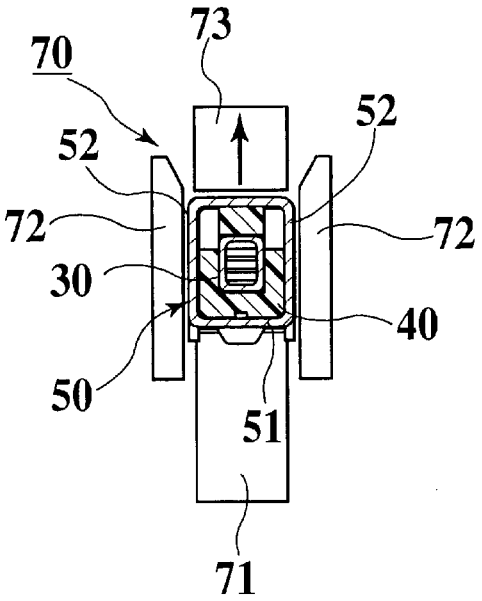
FIG. 11B is a longitudinal sectional view of FIG. 11A.

Consequently, as shown in FIGS. 11A and 11B, the pair of side jigs 72, 72 operate to press the pair of half-box parts 52, 52 of the shield terminal 50 to the direction to approach the end faces 52*a*, 52*a* each other, while the upper front jig 73 presses the top faces of the half-box parts 52, 52 downward. In this way, the pair of half-box parts 52, 52 are plastically deformed from their opening state to their closing state. Under this closing condition, the opposing end faces 52*a*, 52*a* of the pair of half-box parts 52, 52 butts each other and the inner faces 52*b*, 52*b* come into contact with the whole periphery of the inner housing 40 while the inner faces 52*c*, 52*c* come into contact with the whole periphery of the braided wire 23 of the shield wire 20. Thus, in this arrangement, the pair of half-box parts 52, 52 of the shield terminal 50 do cover the inner terminal 30 and a part of braided wire 23 on the side of the insulating inner rind 22 generally completely.

Further, the upper rear jig 74 of the press-fitting machine 70 downward presses the respective press-fitting pieces 53, 53 for braided wire and the respective press-fitting pieces 54, 54 for insulating outer rind for crimping, so that the respective press-fitting pieces 53, 53 are pressure-fitted to the braided wire 23 and the respective press-fitting pieces 54, 54 are pressure-fitted to the insulating outer rind 24 owing to this crimping. That is, according to the embodiment, it is simultaneously carried out to close the shield terminal 50 and crimp both braided wire 23 and insulating outer rind 24.

Figure 13:
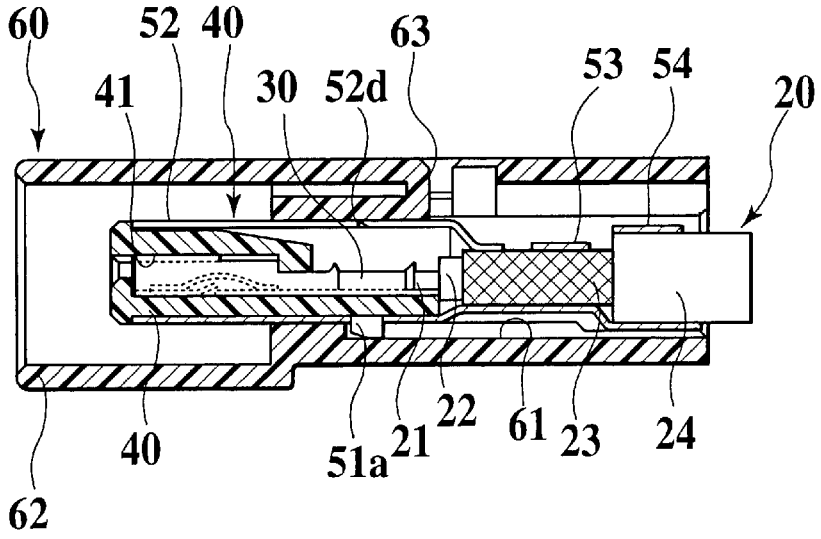
FIG. 13 is a sectional view of the end structure, showing a condition after fitting the shield terminal to the outer housing.

Next, as shown in FIG. 12, when the shield terminal 50 assembled to the end of the shield wire 20 is accommodated in the terminal accommodating part 61 of the outer housing 60, then the lower claw 51*a* and the upper claws 52*d*, 52*d* are engaged on the inner wall of the terminal accommodating part 61 of the outer housing 60 to lock the terminal 50 in the outer housing 60, as shown in FIG. 13.

Next, as shown in FIG. 14, the spacer 65 is inserted into the spacer insertion hole 63 of the outer housing 60. Consequently, as shown in FIG. 15, the spacer 65 comes into contact with respective rear ends of the half-box parts 52, 52 to lock the shield terminal 50 in double. That is, it is executed to fit the outer housing 60 about the periphery of the shield terminal 50 in the outer housing fitting process, completing the assembling of the coaxial connector 10.

In the crimping process about the braided wire 23 in the above assembling process, owing to the press-fitting operation of the respective press-fitting pieces 53, 53 onto the braided wire 23, the shield terminal 50 is electrically connected to the braided wire 23 while the shield terminal 50 is secured to the shield wire 20. Note, since the crimping on the insulating outer rind's side allows the shield terminal 50 to be fixed to the insulating outer rind 24 in the above-mentioned embodiment, the shield terminal 50 is fixed to the shield wire 20 strongly.

Again, in the closing process of the shield terminal 50 in the assembling process, when the pair of half-box parts 52, 52 are plastically deformed into the closing position, then the opposing end faces 52*a*, 52*a* of the pair of half-box parts 52, 52 butt each other, while the end faces 52*b*, 52*b* come into contact with the whole periphery of the inner housing 40 and the end faces 52*c*, 52*c* come into contact with the whole periphery of the braided wire 23. Thus, the pair of half-box parts 52, 52 of the shield terminal 50 do cover the inner terminal 30 and the part of braided wire 23 on the side of the insulating inner rind 22 generally completely. Consequently, in even a high-frequency band range, the superior shielding capability can be effected by the single shield terminal 50. Therefore, according to the embodiment, there is no need of the conventional shield members, neither causing to increase the number of components nor that of assembling steps.

Additionally, since the shield terminal closing process is carried out simultaneously to the crimping process to fit the braided wire 23 under pressure and the crimping process to fit the insulating outer rind 24 under pressure, the processing of the shield terminal 50 can be performed by one press-fitting process in the press-fitting machine 70, whereby the assembling process can be executed effectively.

Finally, it will be understood by those skilled in the art that the foregoing description is one of preferred embodiments of the disclosed end structure of the coaxial connector and the treating method, and that various changes and modifications may be made to the present invention without departing from the spirit and scope of the invention.

For example, although the shield terminal is provided with a pair of half-box parts and respective press-fitting pieces for both braided wire and insulating outer rind in the above-mentioned embodiment, the present invention is applicable to a shield terminal having a pair of half-box parts and press-fitting pieces for braided wire only. Further, although the inner terminal in the shown embodiment is identical to a female terminal, of course, the present invention is also applicable to a male inner terminal.

What is claimed is:

1. An end structure for a coaxial connector comprising:

a shield wire having a conductive core, an insulating inner rind covering the core, a conductive braided wire covering the insulating inner rind and an insulating outer rind covering the braided wire, the shield wire being partially peeled at an end thereof so as to expose the core, the insulating inner rind and the braided wire;

an inner terminal for being press-fitted to the exposed core for electrical connection;

an inner housing made of insulating material, the inner housing having an inner terminal accommodating part formed for accommodating the inner terminal inserted thereinto;

a shield terminal for being assembled to the inner housing and the exposed braided wire so as to attain an electrical connection with the braided wire, the shield terminal being configured to be connectable with the exposed braided wire by press-fitting of the shield terminal so as to cover at least the inner terminal and the exposed insulating inner rind;

wherein the shield terminal includes:

a bottom part;

a pair of half-box parts formed to stand on both sides of the bottom part integrally and allow plastic deformation due to press-fitting to their closing position where respective opposing end faces of the half-box parts abut each other; and a pair of press-fitting parts formed to stand on both sides of the bottom part also configured to be connectable with the exposed braided wire by press fitting of the press-fitting together;

wherein the inner housing, inner terminal and the exposed braided wire's part on the insulating inner rinds side are covered with the pair of half-box parts being deformed to their closing position, while the exposed braided wire is connected to the pair of press-fitting parts by the press-fitting parts being press-fitted to the exposed braided wire; and wherein the inner housing is provided, in the inner terminal accommodating part, with a flexible hook for engagement with the inner terminal.

2. An end structure as claimed in claim 1, wherein the whole periphery of the inner housing is brought into contact with the opposing end faces on the side of respective front ends of the half-box parts being deformed to their closing position, while the whole periphery of the braided wire is brought into contact with the opposing end faces on the side of respective rear ends of the half-box parts being deformed to their closing position.

3. An end structure as claimed in claim 2, further comprising an outer housing made of insulating material and having a terminal accommodating part formed for accommodating the shield terminal being assembled to the shield wire, wherein the shield terminal has a lower engagement claw formed on the bottom part for engagement with the outer housing and upper engagement claws formed on the half-box parts for engagement with the outer housing.

4. An end structure for a coaxial connector comprising:

a shield wire having a conductive core, an insulating inner rind covering the core, a conductive braided wire covering the insulating inner rind and an insulating outer rind covering the braided wire, the shield wire being partially peeled at an end thereof so as to expose the core, the insulating inner rind and the braided wire;

an inner terminal for being press-fitted to the exposed core for electrical connection;

an inner housing made of insulating material, the inner housing having inner terminal accommodating part formed for accommodating the inner terminal inserted therein;

a shield terminal for being assembled to the inner terminal and the exposed braided wire through the inner housing so as to attain an electrical connection with the braided wire, the shield terminal being configured to be connectable with the exposed braided wire by the shield terminal's press-fitting so as to cover at least the inner terminal and the exposed insulating inner rind;

wherein the shield terminal includes:

a bottom part;

a pair of half-box parts formed to stand on both sides of the bottom part integrally and allow plastic deformation due to press-fitting to their closing position where respective opposing end faces of the half-box parts butt each other; and a pair of press-fitting parts formed to stand on both sides of the bottom part and also configured to be connectable with the exposed braided wire by the press-fitting parts' press-fitting;

wherein the inner housing, the inner terminal and the exposed braided wire's part on the insulating inner rind's side are covered with the pair of half-box parts being deformed to their closing position, while the exposed braided wire is connected to the pair of press-fitting parts for being press-fitted to the exposed braided wire; and a spacer for locking the shield terminal accommodated in the outer housing, wherein the outer housing has a spacer inserting hole allowing the spacer to be inserted thereinto.

* * * * *

UNITED STATES PATENT AND TRADEMARK OFFICE

CERTIFICATE OF CORRECTION

PATENT NO. : 6,305,977 B1
DATED : October 23, 2001
INVENTOR(S) : Masahito Ozaki

It is certified that error appears in the above-identified patent and that said Letters Patent is hereby corrected as shown below:

Title page,
Item [57], ABSTRACT,
Line 4, please change "par" to -- part --.

Column 1,
Line 44, please change "tore" to -- core --.

Column 3,
Line 45, please insert -- between the inner housing and the inner terminal is further strengthened. --

Column 8,
Line 19, please change "downward" to -- dowdwardly --.

Column 9,
Line 60, please change "rinds" to -- rind's --.

Signed and Sealed this

Second Day of July, 2002

*Attest:*

*Attesting Officer*

JAMES E. ROGAN
*Director of the United States Patent and Trademark Office*